United States Patent [19]

Fischer

[11] 4,432,539

[45] Feb. 21, 1984

[54] SHEET FEEDING SYSTEM FOR PRINTING MACHINES

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 280,988

[22] Filed: Jul. 6, 1981

[51] Int. Cl.[3] ..... B65H 5/10

[52] U.S. Cl. ..... 271/3.1; 271/9; 271/105; 271/128; 271/146

[58] Field of Search ..... 271/9, 42, 128, 130, 271/146, 105, 3.1

[56] References Cited

U.S. PATENT DOCUMENTS

| | | | |
|---|---|---|---|
| 1,633,937 | 6/1927 | Ford | 271/146 X |
| 3,914,154 | 10/1975 | Pfeiffer | 271/9 |
| 4,184,672 | 1/1980 | Watkins | 271/105 |
| 4,211,398 | 7/1980 | Bishop | 271/9 |
| 4,247,093 | 1/1981 | Kistner | 271/3.1 |

FOREIGN PATENT DOCUMENTS 1786545 10/1977 Fed. Rep. of Germany .

*Primary Examiner*—Richard A. Schacher

*Attorney, Agent, or Firm*—Frishauf, Holtz, Goodman & Woodward

[57] ABSTRACT

Automatic transfer of one (4*a*) or a group or package (4'*a*) of secondary or scrap sheets from a stack (4) over a stack (3) of primary or good-quality sheets on which printing is to be effected, is controlled, for example by a microprocessor control system (12) by placing a stack (4) of secondary sheets adjacent the stack (3) of primary sheets. A secondary sheet transport system (9, 10, 11; 20, 9; 26, 27, 229, 32, 33) grips at least one (4*a*) or a package (4'*a*) of secondary sheets and pushes, pulls or similarly transfers the sheet or package of sheets over the topmost one of the primary sheets. To facilitate separation of sheets, a blower is provided blowing air against the edge of the secondary sheets where pick-up is to be effected. Automatic control is possible by introducing into the control unit monitoring signals derived from the printing machine.

15 Claims, 4 Drawing Figures

SHEET FEEDING SYSTEM FOR PRINTING MACHINES

The present invention relates to printing machines, and more particularly to sheet-fed printing machines in which, selectively, paper sheets on which printing is to be effected are fed from a stack and which permits, automatically, to insert sheets from a stack carrying waste or scrap sheets for testing of the printing effect of the machine, or to provide for initial run-through on waste or scrap paper.

BACKGROUND

Various types of sheet feeding apparatus to provide sheets to printing machines are known, in which the sheets are placed on a stack which is height-adjustable, so that the sheets are then peeled off and transported to a make-ready table. One sheet supply apparatus of this type is described, for example, in German Published Patent Application No. DE-AS 17 86 545.

If it is desired to save paper and not effect initial run-through of printing runs on high-quality paper, it was heretofore necessary to place a stack of secondary or waste or scrap paper manually on the stack which contained the good, high-quality paper. It is frequently desirable to save such high-quality paper and replace these sheets of paper by scrap when, for example, a stoppage occurred in the printing run and the subsequent run-on of the machine might produce further scrap.

THE INVENTION

It is an object to provide an automatic paper feed apparatus which permits, automatically, transfer of printing from good, or primary, paper to scrap, or secondary, paper sheets.

Briefly, a secondary sheet stack is positioned laterally adjacent the primary sheet stack, parallel to an edge of the primary sheets. The secondary sheet stack can be selectively introduced for printing in the printing machine and, to do so, a separator is provided to separate individual or packets of secondary sheets from the stack, which is carried on a secondary sheet stacking transport which, preferably, travels at a level with the primary stack; a secondary sheet transport is provided which moves the secondary sheets, under command, laterally over the primary sheets, to be then picked up by the normal machine feeding means to be transported over a make-ready table for subsequent printing on the secondary sheet.

In accordance with a feature of the invention, the secondary sheet or the package of sheets is pulled in a path which extends over the top sheet of the primary stack, for example by a slightly raised path, by slightly lowering the primary stack, or by so controlling the path that it will be reliably fed over the top sheet of the primary stack, for example by grippers initially picking up the top sheet or the group of sheets forming the package, the further transport being effected by rollers, by grippers operating under control of a spindle, or the like. Preferably, an automatic apparatus is provided coupled to the printing machine control system which, when a malfunction is sensed, causes one or more of the scrap papers to be transported over the primary stack upon resumption of printing.

The apparatus has the advantage that secondary or scrap sheets can be placed over the normal printing apparatus by an automatic control system, for example a simple microprocessor, which responds in dependence on various operating conditions to individually change over the sheet transport path from the primary stack to place secondary sheets on top of the primary stack. The arrangement eases the work load on the printing operators, which also overall reduces printing costs, since transfer of secondary sheets is carried out automatically and in time so that, always, secondary sheets can be used rather than primary sheets before primary sheets have been wasted. This is particularly important in case of machine stoppages by reducing the cost of primary paper, which is ever increasing, and which permits use of secondary or scrap sheets which are available in sufficient quantity. The correct number of scrap sheets will always be used, so that it is no longer necessary to take a guess as to how many scrap sheets may be required—which will always result in some waste, either of printing time or of primary sheets. The secondary sheets can likewise be used if printing differences arise which, for example, are due to non-uniformities in the inking system, in the damping system of offset machines, and the like, which can be checked by use of secondary sheets; after such differences in inking or damping, for example, have worked themselves off, printing with the secondary sheets is interrupted merely by stopping feed of secondary sheets over the primary sheets, and normal printing can commence. The time-consuming and heavy work of hand-feeding secondary sheets during stoppage of the machine can thus be completely eliminated, so that full attention by the operator can by given to the actual cause of difficulties, and the operator is available for other tasks than hand-feeding stacked secondary sheets.

The stack of secondary sheets is controlled to have, at the top, at least approximately the level of the primary sheets, so that the stack of secondary sheets can be replenished in a large package. Of course, the sizes of the secondary sheets must be the same as those of the primary sheets. In accordance with a preferred feature of the invention, a blower is used to facilitate separation of secondary sheets which, in order to save energy, is normally inoperative and started only when it is desired to transfer secondary sheets to the stack of the primary sheets, under control of the operating control unit.

DRAWINGS

Figure 1:
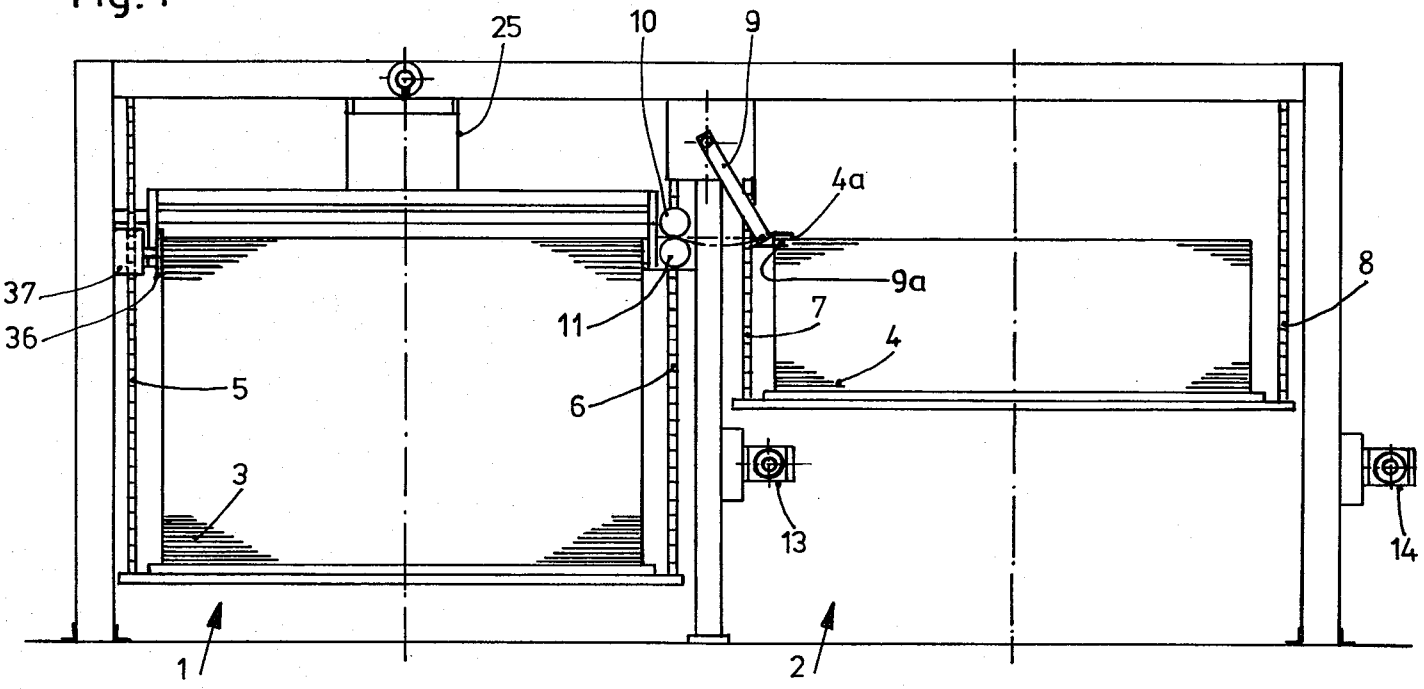
FIG. 1 is a highly schematic side view of a printing sheet feeding system in accordance with the invention.

Two sheet feeding means or devices are provided, the sheet feeding apparatus 1 being loaded with a stack 3 of primary sheets for the printing, and the device 2 being loaded with a stack 4 of secondary sheets, which may already have some printing on it, and which are used, for example, on the reverse, or for other purposes, the secondary sheets generally being waste or scrap. The device 2 is located at one of the three readily accessible sides of the device 1, preferably laterally, and parallel thereto.

The stack 3 is supported on a platform which is suspended on chains 5, 6 which are driven by a suitable and well known drive system, to lift the stack in such a manner that the uppermost sheet of the stack 3 is in a position which permits feeding to a make-ready table—not shown. This portion of the apparatus can be standard in accordance with any well known construction.

In accordance with the invention, the stack 4 is provided, located laterally of the stack 3, and likewise retained on a platform which is lifted by chains 7, 8, which are so operated that the upper edge of the secondary sheet from the stack 4 is at least approximately even and preferably slightly higher than the uppermost sheet of the stack 3. Thus, the chains 7, 8 may move similar to the chains 5, 6, when sheets are fed therefrom. It is particularly desirable that the uppermost sheet 4*a* of the stack 4 be slightly above the level of the upper sheet of the stack 3. The formats of the sheets, of course, should be the same since the alignment of the scrap or secondary sheets is effected similarly to the alignment of the primary sheets from stack 3.

Let it be assumed that upon starting of the printing machine, for preliminary work or the like, re-starting after an interruption, or the like, it is desired to save primary sheets from the stack 3. A single one or a package of secondary sheets, of which the uppermost one is sheet 4*a*, is to be transferred above the uppermost sheet of the stack 3. A gripper, which preferably has two portions, an upper gripping tongue and a lower gripping tongue 9*a*, is inserted between a selected number of sheets from the secondary stack to pick up a package of secondary sheets from the stack 4. The gripper is pivoted on a pivot arm 9, and driven by a suitable drive—not shown—to pivot the arm 9 in the direction of the broken like—FIG. 1—to feed the secondary sheets which have been picked up through a pair of transport rollers 10 and 11 and push the secondary sheets over the topmost sheet of the stack 3 of the primary sheets. The pivot arm 9 can be pivoted by any suitable and well known drive, for example a small electric motor, a solenoid, or the like, and is returned to the position shown in FIG. 1 after the package of secondary sheets has been gripped by the rollers 10, 11. The gripper itself can be of any well known and standard construction, releasing the secondary sheets when they are picked up between the rollers. Return can be under spring pressure or by a reversing power drive.

Figure 2:
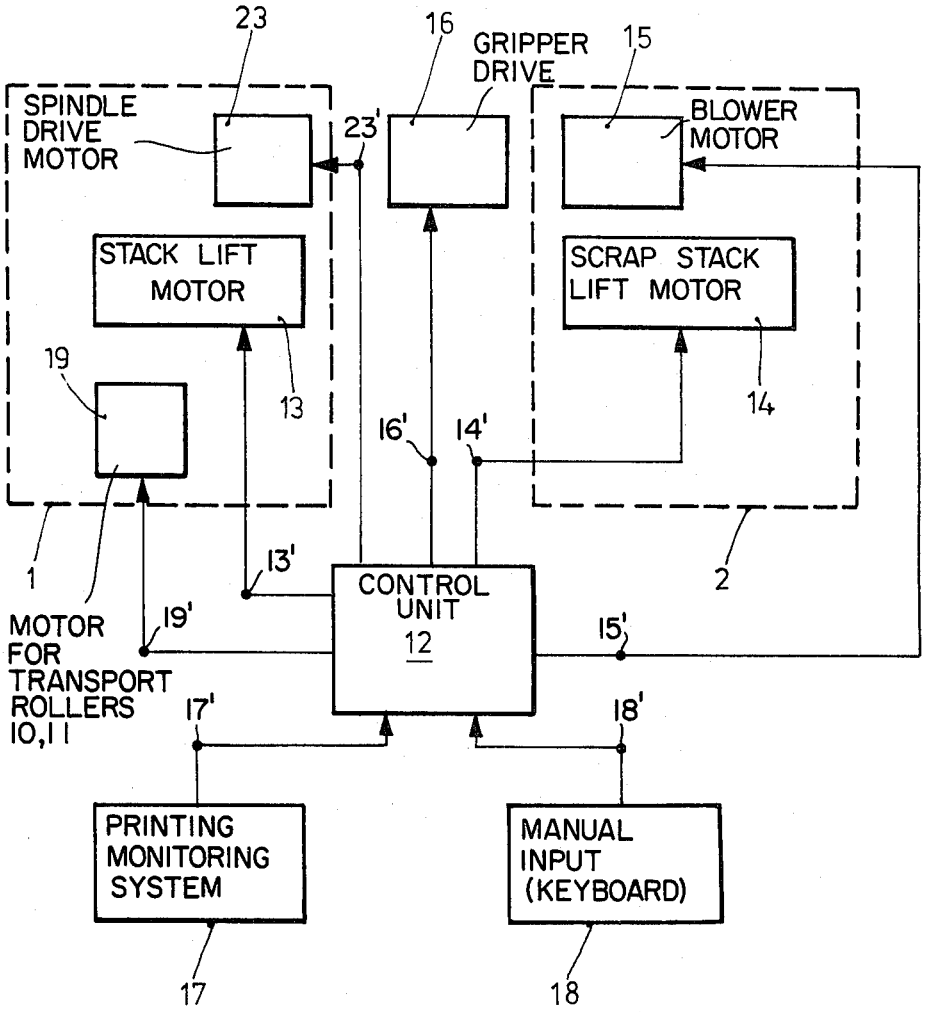
FIG. 2 is a block diagram of the control system.

Transfer of a group or package or a single one of secondary sheets is controlled by a control unit, FIG. 2, which has a central control 12, for example a microprocessor. FIG. 2 illustrates the general block circuit diagram of the control system. The control unit 12 receives input signals from a printing monitoring system 17, or from a manual input unit, for example a keyboard 18. The signals are applied at terminals 17', 18'. The control unit has output terminals 13', 14', 15', 16', 19' to control respective operating units. Control unit 12, at its output terminal 13', controls operation of the stack lift motor 13 for drive of the chains 5, 6 of the primary stack 2 in the device 1. Similarly, terminal 14' is provided to control drive of a scrap stack lift motor 14 coupled to the chains 7, 8 of the secondary stacking device 2, retaining the stacks 4 of secondary sheets. A blower motor 15 is connected to terminal 15', the blower directing air against the edge of the secondary stack (not shown in FIGS. 1 and 3) to facilitate insertion of the tongue 9*a* of the sheet gripper. The gripper drive 16 is connected to terminal 16' to control transfer of the secondary sheet or package or group of secondary sheets from the stack 4 over the topmost sheet of stack 3. The control unit 12, thus, provides suitably timed output signals, in accordance with input commands derived from either a printing monitoring system 17 or a manual, for example keyboard input 18. The printing monitoring system 17, already usually available on many modern printing machines, monitors operating conditions arising within the machine, and provides output signals which, for example, have indicated that a stoppage resulted, and that subsequent printing may be improper for at least several sheets, thus providing signals requiring secondary sheets for printing. To manually control the system, a keyboard 18 is provided with suitable keys, for example indicating the number of secondary sheets to be supplied, an interruption or stop button, and the like, so that manual control of the system is likewise possible. Drive motor 19 provided to drive the transport rollers 10, 11 is connected to terminal 19'.

Figure 3:
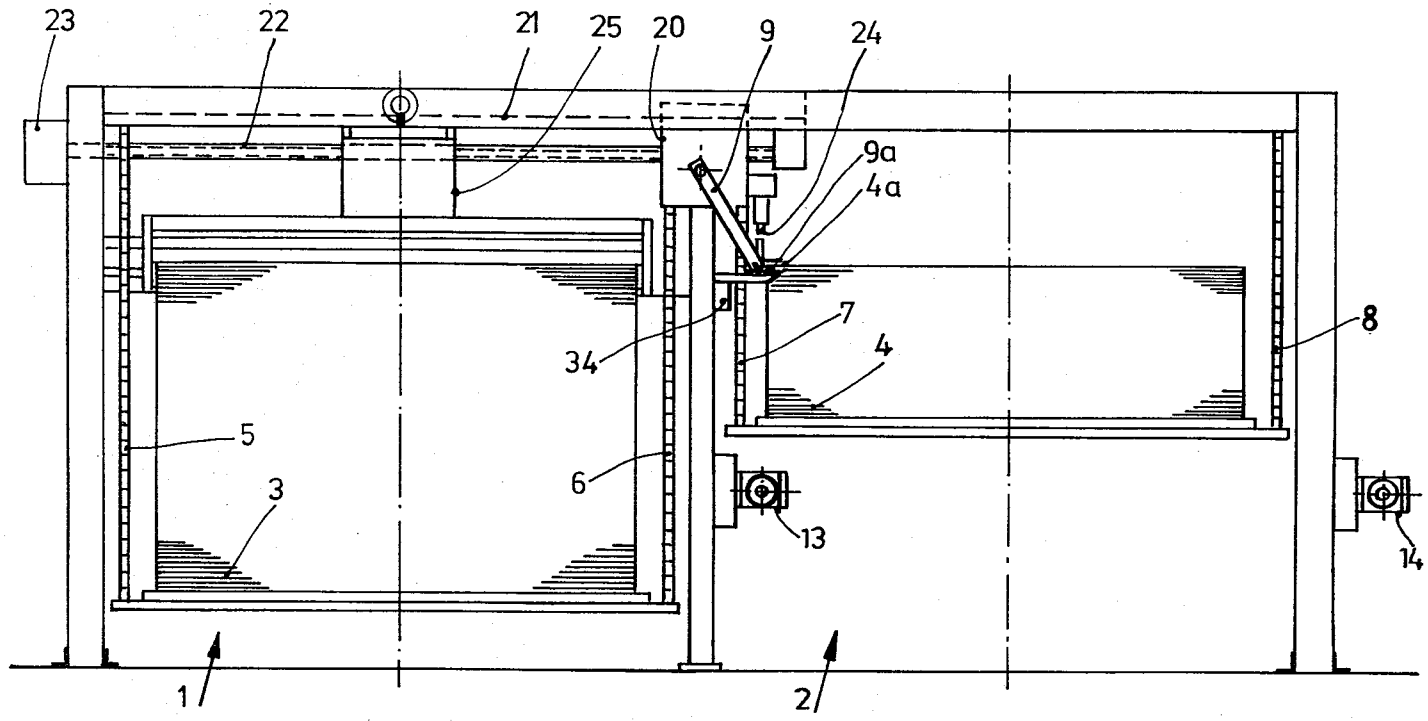
FIG. 3 is a highly schematic side view of a second embodiment of the secondary sheet feeding system.

Embodiment of FIG. 3: The sheet transfer gripper apparatus 9 is secured on a slide 20 which is movable on a track 21 over the stack 3. A threaded spindle 22 is connected to a motor 23 which is of the eversing type, so that it can operate in either direction. Upon energization of the motor 23 in one direction, spindle 22 is so rotated that the slide 20, and with it a package or group of secondary sheets, are moved by the gripper 9 from right towards left—with respect to FIG. 3—and then, after release of the package or group of secondary sheets, back into a ready position for subsequent pick-up of further secondary sheets.

The transport rollers 10, 11 of FIG. 1 are not necessary, since the entire transfer operation is carried out by the sheet gripper system 9, which is moved back and forth. Motor 23 is likewise controlled from the center control unit 12 (FIG. 2), for example suitably connected to a terminal 19', the motor reversing, for example, when the slide 20 engages a limit switch. A suitable location of the spindle 22 in a free passage laterally of a suction manifold 25 can readily be arranged on an existing machine. After placing a group or package of secondary sheets on the stack 3, the pick-up 9 is placed out of engaging position, for example being lifted by an electromagnet 24 which is located on a telescoping arm on the slider 20, so that it is transferred back to the stack 4 of secondary sheets in raised position without contacting the uppermost sheet of the stack 3 which, now, contains, as the uppermost sheets, the group or package of secondary sheets from the stack 4. Thus, contacting and misalignment of the uppermost sheet of secondary stacks by the gripper 9 is prevented.

Figure 4:
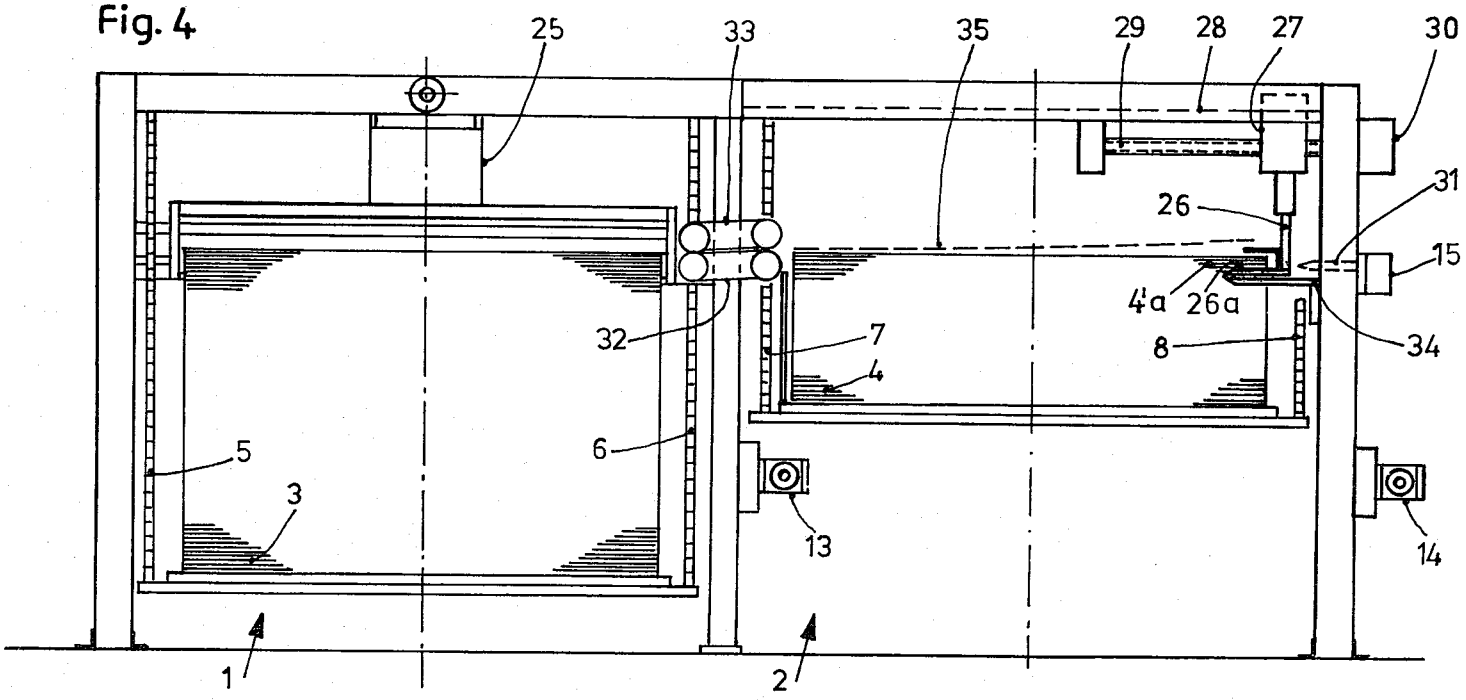
FIG. 4 is a view similar to FIG. 3, illustrating a third embodiment.

Embodiment of FIG. 4: A package 4'*a* of secondary sheets from the stack 4 is picked up by a sheet gripper 26 which operates as a push slider. Sheet gripper 26*a* operating as a separating tongue which pushes the group or package 4'*a* of secondary sheets over the stack 3 of primary sheets. The sheet gripper 26 is secured to a slider 27 which runs on a track 28, in reversing direction, between right and left. The gripper 26 is moved by a reversely rotatable spindle 29 driven by a motor 30, in respectively opposte direction. Similarly to the embodiment of FIG. 3, the gripper 26 can be returned to its initial or starting position by attachment to a telescoping arm on a path which is lifted over the topmost sheet of the remainder of the sheets of the stack 4 after having transported a package 4'*a* towards the left.

FIG. 4 also shows a blower 31 to faciliate separation of the edges of the sheets of the stack 4, so that the tongue 26*a* can pick up a suitable package 4'*a* of secondary sheets. A hold-down element 34 is positioned in one of the side walls of the machine, below the gripper 26.

The hold-down element 34 is height-adjustable, and pivotable or slidable in an out of the stack 4 and the hold-down element 34 holds the remaining sheets on stack 4 in position as the topmost package or group 4'a is being fed to the left.

The gripper 26 pushes the package 4'a towards the left so that it becomes gripped between two transport belts 32, 33 which can be used in lieu of the rollers 10, 11 (FIG. 1), the transport belts 32, 33 effecting complete and final transfer of the package 4'a of secondary sheets.

The stack 4 of secondary sheets can be slightly inclined towards the stack 3 of primary sheets; this facilitates transfer, the direction of inclination being shown by the broken line 35. This inclination can readily be effected by suitable positioning of the transport platform on the chains 7, 8 or by location of the chains 7, 8 in respectively height-offset position. The friction which results upon lateral sliding transfer of the package of group 4'a of the secondary sheets is thus reduced.

Of course, spindle 29 can extend not only partly, but entirely across the stack 4, that is, over to the left side wall or side support element of the stacking device 2 for the secondary sheet stack 4. It may then be possible to avoid the necessity of a separate transport element moving sheet 4'a across the stack 3, such as the belts 32, 33, particularly if the secondary stack 4 is not level, but at an inclination as shown by the broken line 35.

The remainder of the apparatus, particularly with regard to the stack 3, is standard; vibrator plates and alignment plates for preliminary alignment, particularly of the uppermost sheets of the stack 3, can be provided, so that the sheets which are being transferred from the stack 4 over to the stack 3 likewise will have preliminary alignment. Only a single such alignment plate 36 coupled to a vibrator 37 is schematically indicated in FIG. 1 to show one possible position without detracting from the clarity of the remainder of the illustration.

The control unit 12 can be suitably connected to the motors 23 (FIG. 3), 29 (FIG. 4), for example to terminal 16' or 19', with suitable timing or ON/OFF control by means of limit switches which are connected back to the control unit to effect power connection of the motors in suitable rhythm; separate outputs can, likewise, be provided; the particular type of connection of the control unit is a matter of design in accordance with operating requirements.

Various changes and modifications may be made, and features described in connection with any one of the embodiments may be used with any of the others, within the scope of the inventive concept. For example, the blower 31 is desirably used in all of the embodiments, located adjacent the respective gripper to fluff the edges of the sheets of the secondary stack so that a suitable package or group 4'a can be picked up readily. Separate outputs for the respective elements used can be provided on control unit 12. The control unit 12 additionally can be programmed to operate the primary stack lift motor 13 and the scrap stack lift motor 14 to lower the primary stack 3 and raise the secondary stack 4 to additinally facilitate transfer of at least one secondary sheet 4a, or a group or package 4'a of secondary sheets over the topmost sheet of the stack 3 of the primary sheets.

I claim:

1. Printing machine sheet feeding system having primary means (1) for stacking sheet and for removal therefrom of sheets, one-by-one, for printing thereon, and comprising a secondary sheet stacking means (2) located laterally adjacent the primary sheet stacing means (1) and parallel to an edge of the sheets in the primary sheet stacking means, said secondary sheet stacking means being adapted to hold secondary or scrap or waste sheets for selective introduction into the printing machine prior to printing on the sheets in the primary sheet stacking means;

separating means (9a, 26a) comprising a gripper means (9, 9a; 26, 26a) separating a plurality of secondary sheets from the secondary stack (4) to form a package of secondary sheets and positioned for gripping said package of sheets from the secondary stack (4), said gripper means being movable for moving said package of sheets towards the primary stack (3);

and secondary sheet transport means (9, 20, 21, 22, 23; 26, 27, 28, 29, 30) movable between said secondary and primary sheet stacking means and transporting separated secondary sheets (4a 4'a) from the secondary stack (4) to and over the topmost sheet of the primary stack (3).

2. Machine according to claim 1, wherein the primary sheet stacking means is height adjustable.

3. Machine according to claim 1, wherein said additional transport means comprises transport rollers or belts (10, 11; 32, 33).

4. Machine according to claim 1, wherein (FIG. 3) the gripper means comprises a gripper (9) positioned to engage a package or a group of sheets (4'a) of the sheets on the secondary stack (4) at an edge adjacent the primary stack (3);

a pulling slide system (21, 22, 23) moving said gripper over the stack (3) of primary sheets;

and means (24) returning said gripper means, upon reversal of operation of said pulling slide, to the starting position at a level above that of the topmost sheet of the stack (3) of primary sheets.

5. Machine according to claim 4, wherein said pulling slide system comprises a reversing motor (23) and a reversing spindle (22);

and a slide (20) threadedly engaged with said spindle for reversing to-and-fro movement from the secondary stack (4) over the primary stack (3).

6. Machine according to claim 4, wherein said returning means comprises a lifter (23) lifting the gripper (9) above the level of the uppermost sheet on the primary stack (3) after transfer of said package of secondary sheets (4'a) over the topmost sheet on the primary stack.

7. Machine according to claim 1, wherein (FIG. 4) the gripper means comprises a gripper (26) positioned to engage a group or package of secondary sheets (4'a) at an edge remote from that adjacent the stack (3) of primary sheets; and means are provided for moving said gripper towards the stack (3) of primary sheets to thus push the said package of secondary sheets to and over the stack (3) of primary sheets.

8. Machine according to claim 7, further including additional transport means receiving said package or group (4'a) of secondary sheets and transferring said at least one or group or package of secondary sheets over the stack of primary sheets (3).

9. Machine according to claim 1, including means (7, 8) supporting the stack (4) of secondary sheets, said support means supporting said secondary sheets in a plane (35) which is inclined towards the stack (3) of primary sheets.

10. Machine according to claim 1, further including primary sheet support and lifting means (5, 6, 13);

and control means (12) connected to and controlling said primary sheet support and lifting means to lower the stack (3) of primary sheets corresponding at least to the thickness of a package or group of secondary sheets (4a, 4'a) prior to transfer of said package of secondary sheets over the topmost sheet of the stack of primary sheets.

11. Machine according to claim 1, wherein said separating means further includes a blower (15, 31) positioned adjacent the edge of the sheets of the stack (4) of secondary sheets close to said secondary sheet transport means.

12. Machine according to claim 1, further including a central control unit (12) controlling respectively timed operation of said separating means and said secondary sheet transport means.

13. Machine according to claim 12, wherein the central control unit comprises a microprocessor element.

14. Machine according to claim 1, further including support means (7, 8, 14) height-adjustably supporting the stack (4) of secondary sheets.

15. Machine according to claim 1, further including at least one vibrating alignment plate (36, 37) located on at least one edge of the stack (3) of primary sheets adjacent the top sheet thereof to effect preliminary alignment of the topmost sheets of the stack (3) of primary sheets or at least one or a group or package of secondary sheets (4a, 4'a) being transferred to and over the topmost sheet of said stack (3) of primary sheets.

* * * * *